US005286908A

United States Patent [19]

Jungleib

[11] Patent Number: 5,286,908

[45] Date of Patent: Feb. 15, 1994

[54] MULTI-MEDIA SYSTEM INCLUDING BI-DIRECTIONAL MUSIC-TO-GRAPHIC DISPLAY INTERFACE

[76] Inventor: Stanley Jungleib, 766 Allen Ct., Palo Alto, Calif. 94303-4110

[21] Appl. No.: 693,810

[22] Filed: Apr. 30, 1991

[51] Int. Cl.[5] ..... G10H 7/00

[52] U.S. Cl. ..... 81/603; 84/DIG. 6; 84/478; 84/609

[58] Field of Search ..... 84/600-603, 84/609, 645, 453, 462, 478, DIG. 6

[56] References Cited

U.S. PATENT DOCUMENTS

| | | | |
|---|---|---|---|
| 4,215,343 | 7/1980 | Ejiri et al. | 84/DIG. 6 X |
| 4,366,741 | 1/1983 | Titus | 84/478 |
| 4,419,920 | 12/1983 | Ohe | 84/602 |
| 4,658,427 | 4/1987 | Aubin | 84/DIG. 6 X |
| 4,833,962 | 5/1989 | Mazzola et al. | 84/602 |
| 4,960,031 | 10/1990 | Farrand | 84/609 |
| 4,991,218 | 2/1991 | Kramer | 84/622 X |
| 5,005,459 | 4/1991 | Adachi et al. | 84/453 |
| 5,027,689 | 7/1991 | Fujimori | 84/622 |
| 5,048,390 | 9/1991 | Adachi et al. | 84/464 R |
| 5,062,097 | 10/1991 | Kumaoka | 84/645 X |
| 5,085,116 | 2/1992 | Nakata et al. | 84/609 |
| 5,092,216 | 3/1992 | Wadhams | 84/602 |
| 5,220,117 | 6/1993 | Yamada et al. | 84/600 |
| 5,231,488 | 7/1993 | Mohrbacher et al. . | |

*Primary Examiner*—William M. Shoop, Jr.
*Assistant Examiner*—Jeffrey W. Donels
*Attorney, Agent, or Firm*—John S. Ferrell

[57] ABSTRACT

The disclosed invention provides a music-controlled graphic interface for closely binding musical and graphical information. The invention comprises a digital instrument interface, a computer device for translating digital musical sequences into graphical display information, and one or more displays for presenting the graphical information. Digital musical information is used to access graphical information. The accessing of the graphical information can be accomplished using the digital musical information as an index to a stored look-up table of video/graphic data. Alternatively, the musical information can serve as an input into an algorithm to calculate the video data in real time. The invention can also proceed in the backwards direction. Changing graphical data can be used to access musical or other sound information, to create musical sounds that match closely a changing displayed image. The invention allows accurate and rapid synchronization of sound and image, especially in computer animation.

3 Claims, 3 Drawing Sheets

MULTI-MEDIA SYSTEM INCLUDING BI-DIRECTIONAL MUSIC-TO-GRAPHIC DISPLAY INTERFACE

BACKGROUND OF THE INVENTION

The present invention relates to interactive connections between musical instruments and computers, and more particularly to generating and controlling computer graphic images using musical instruments.

Computer technology and software design have led to revolutions in the musical and visual arts. The musical instrument digital interface (MIDI) standard allows interoperability among a wide range of musical and computer devices. The MIDI standard, a public-domain protocol, defines how a generic MIDI transmitter controls a generic MIDI receiver. A MIDI transmitter can be an electronic keyboard or drum machine, a MIDI sequencer that stores and transmits sequences of digital musical information, or an acoustic instrument equipped with an analog-to-digital (A/D) converter. A MIDI receiver can be any device that combines and translates received MIDI sequences into sound. MIDI technology allows the creation of personal programmable electronic orchestras.

The advent of multi-media computer programs has changed the visual arts, particularly those of video images. Multi-media programs allow control of computer-generated animated graphics as well as external video sources. Multimedia presentations blend these various graphical sources together into complex, coherent visual works.

Unfortunately, current multi-media authoring programs do not easily implement MIDI sequences within a graphical presentation. Current multi-media programs do not provide a complete and usable MIDI implementation. Furthermore, current multi-media programs do not have a constant time performance and cannot synchronize to the standard MIDI time codes. The resulting inability to accurately and easily combine sound and picture together into a cohesive work renders current multi-media programs rather useless for professional real-time applications.

Prevailing practice works around these problems by using complex and expensive time code-controlled video overdubbing to connect sound information with visual data. Often, such dubbing must be done on dedicated systems available only to the highest levels of the profession. Given the prevalence of low-cost MIDI equipment and software, and inexpensive multi-media authoring programs, there exists a clear need for simple methods of linking computer animated graphics and other visual information to computer-controlled music.

What is needed is an improved method and system for providing real-time interactivity between MIDI devices, digital audio production and broadcast-quality graphics. An improved music-controlled graphic interface should allow the same MIDI sequencer that plays back musical sequences to control all graphic programming as well. The method and system should provide the performer real-time control over any visual program material, including taped or projected video. In addition, the system and method should allow an open system that can be easily expanded with available components and software, and be easily understood.

SUMMARY OF THE INVENTION

In accordance with the present invention, a music-controlled graphic interface combines a digital instrument interface, a computer device capable of translating digital musical sequences into graphical display information, and one or more displays for presenting the graphical display information. The flexible apparatus and methods of the present invention allow translation and movement of information both forwards, from musical instrument to graphical presentation, and backwards, from graphical presentation to musical instrument.

The computer device used in the present invention comprises several principal components. A computer interface receives and buffers digital signals from the instrument interface. These buffered signals can then be accessed in any desired order by the computer to address a set of script instructions stored in memory. The script instructions in turn address instructions for a media controller that translates the individual musical signals into a set of graphical display instructions. A CRT controller follows these graphical display instructions to drive a CRT or other useful graphical display. Optional user input into the media controller allows for real-time control of the graphical images in addition to that provided by the musical interface.

In the forward mode of operation, the present invention first samples the musical input by the instrument interface to create a set of instrument parameters. These instrument parameters can comprise, among other options, the pitch, spatial orientation, amplitude, or tempo of the musical instrument. In the case of a MIDI sequencer, the instrument and sampler are the same device. The instrument parameters are filtered and normalized to a set of digital instrument parameters by the computer interface. Using the instrument parameters to sequentially access script instructions, and using the script instructions to address stored graphical program instructions in the media controller, translates the set of digital instrument parameters into video information. The video information is then presented on a suitable display.

In the reverse mode of operation, the invention begins with a set of graphical information presented on a display. The computer takes the graphical information used by the media controller to access script instructions, in effect translating backwards from graphical representation to musical representation. The script instructions then provide a sequence of digital music parameters that can be used by the musical instrument to produce sound.

The invention, in both its forward and reverse modes of operation, provides accurate and simple synchronization of music and graphics. The set of script instructions translates between digital musical data and digital video data. Thereby, the invention provides for a simple and modular design, where different graphical effects can be created by exchanging one set of script instructions for another. Moreover, the invention can be practiced with readily available MIDI hardware and multi-media authoring software to create seamless, well-integrated audiovisual presentations. These and other features and advantages of the present invention are apparent from the description below with reference to the following drawings.

DESCRIPTION OF THE PREFERRED EMBODIMENTS

Figure 1:
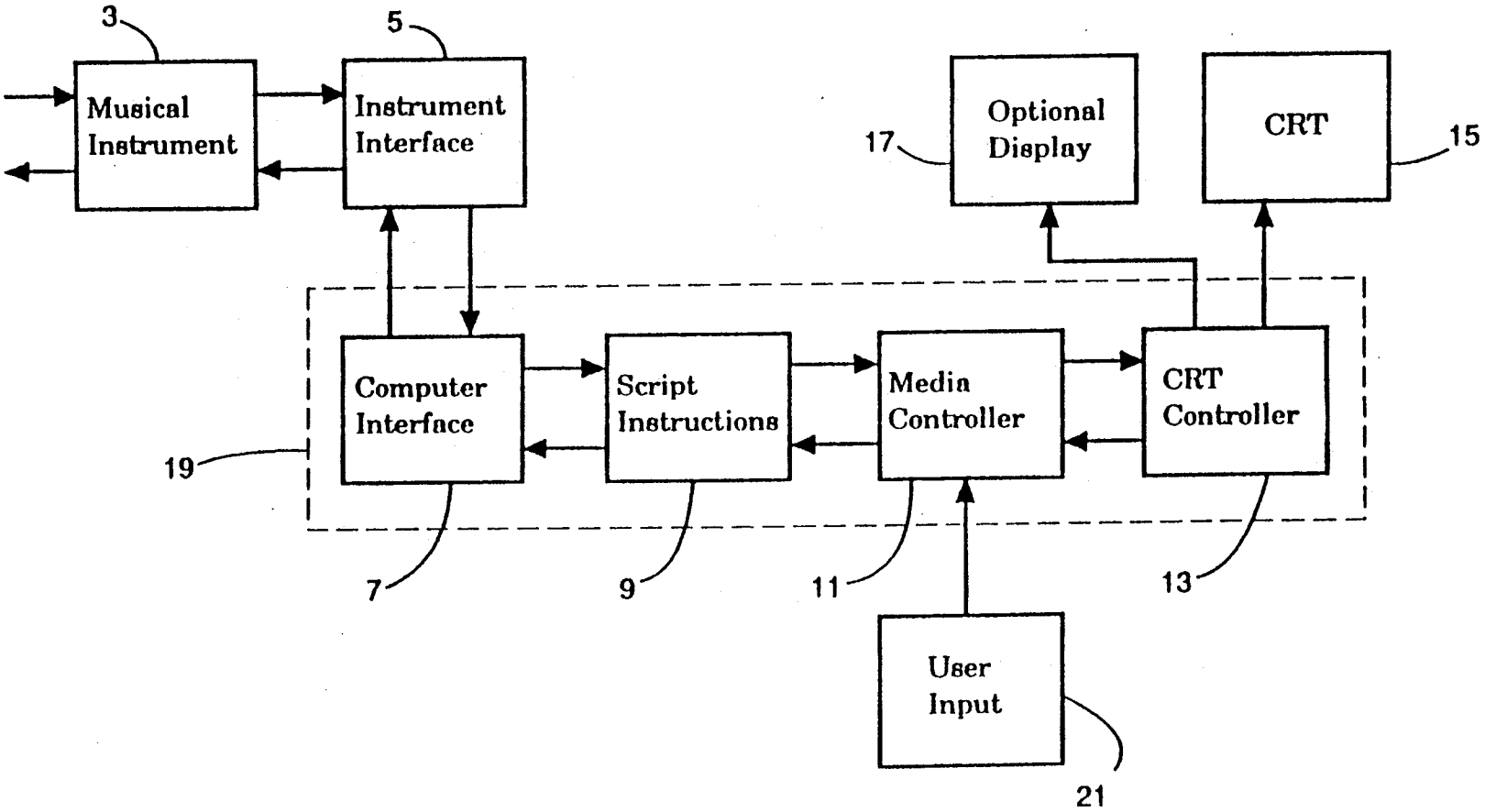
FIG. 1 shows a block diagram of a music-controlled graphic interface system in accordance with the present invention.

In accordance with the present invention, FIG. 1 shows apparatus for a music-controlled graphic interface. A musical instrument 3 provides a source for musical information to an instrument interface 5, which in the preferred embodiment translates the musical information of the instrument 3 into MIDI musical data. Musical instrument 3 and interface 5 can take many forms. The musical instrument 3 can be electronic, as in many keyboards, and already incorporate a MIDI interface for exporting musical information. Furthermore, a MIDI sequencer can function as both the musical instrument 3 and interface 5 for the present invention, transmitting a sequence of MIDI musical data by following a pre-arranged program. Alternatively, the instrument can be acoustic, with a microphone pick-up providing analog signals to the MIDI interface which samples the analog waveform, translates the signal to digital format and applies MIDI protocols for processing the digital musical information.

Regardless of how the musical information is created and processed, the musical data is transmitted to a computer processor 19, comprising a computer interface 7, a script instruction memory storage area 9, a media controller 11, and a CRT controller 13. An Apple Macintosh computer system is used in the preferred embodiment, but many other computer platforms can be used as well. A MIDI computer interface 7 connects between the serial ports of the Macintosh computer and the MIDI instrument interface 5. Any commercially available interface will suffice, but the interface 7 preferably includes a built-in SMPTE time code to MIDI time code converter.

The computer system preferably includes, in additional to a basic operating system, MIDI management software for storing and processing MIDI information. The preferred embodiment uses Ear Level Engineering's HyperMIDI program that enhances the Apple Macintosh's Hypercard program with MIDI input and output capabilities. Apple's MIDI Manager software can also be implemented as part of the MIDI management software to allow several different MIDI music sources to run simultaneously. The MIDI management software enables the script instructions and multi-media controller software of the present invention to access MIDI musical data arriving at the computer interface 7.

The multi-media controller 11, which is implemented in software in the preferred embodiment, comprises Macromind's Director program. Director allows creation of multi-media presentations called "movies". Director has only a limited MIDI implementation, where the program can start and stop an external MIDI sequencer, but it requires a separate MIDI unit and synchronization of sound and visual information disappears when a new animation file loads. Director has no facility for input or output of specific MIDI data and does not support the Apple MIDI Manager. In addition, Director possesses two major timing problems that interfere with accurate synchronization of video and sound. First, Director's response speed changes depending on the particular Macintosh being used. Second, Director's response speed changes depending upon the exact state of the machine, particularly how many windows are open concurrently.

Nevertheless, the Director multi-media authoring program 11 can create complex video graphic presentations incorporating a variety of multi-media inputs such as videotape, videodisc, CD-ROMS and computer graphics. The information from the media controller 11 is then sent to the CRT controller 13 for display on a CRT display screen 15 or other optional display 17. The operation of the Director media controller 11, video controller 13 and graphic displays 15 and 17 are well-known to those skilled in the art.

The present invention uses a feature of Director to control the display of graphical information from the external MIDI source, allowing for accurate synchronizations. Director contains a programming language called Lingo, where Lingo programs are called Scripts. Users of the Director program can use english-like "scripts" to program a given Director "movie". These scripts can accept inputs to alter movie behavior either in response to user input (from user input block 21) or from data or messages passed into the Director program. The present invention creates scripts that react to MIDI information, allowing a multi-media presentation to follow a musical sequence with precise synchronization.

Figure 2:
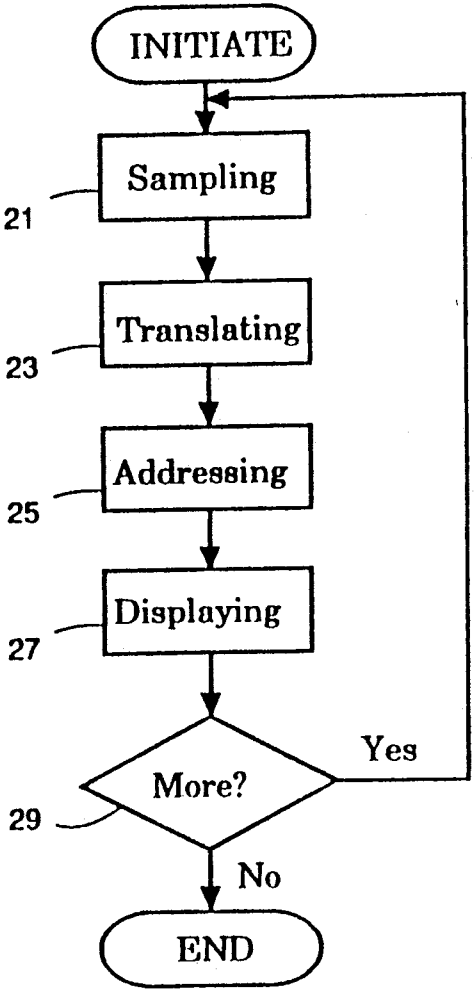
FIG. 2 is a flow chart illustrating principal steps graphical information by a musical device in accordance with the present invention.

The forward mode of operation of the present invention is illustrated in the flow chart of FIG. 2. After initialization of operation, the musical instrument output is sampled 21 to extract one or more parameters, such as frequency, etc. Next, the particular sampled parameters are translated, forming digital (and preferably MIDI) data values. These digital data values are used to address 25 a set of stored video information. The addressing can occur in a variety of methods. One of the simplest is that of a look-up table; each note, for instance, can address a given graphic. Different graphics can then be displayed immediately, based upon the note played. Alternately, the musical data can function as an input into an algorithm in the script. Based upon the data, calculations can change any attribute of the displayed graph. Either of these processes (and other equivalent processes) are understood within the present invention as addressing a set of stored video information. Once the video information has been addressed, either from look-up tables, or by calculation, the resulting graphical information is displayed 27 on an appropriate output device. At branch 29, the system looks for further information. If there is more musical information, the process continues. If not, the sampling and display procedures come to an end.

Figure 3:
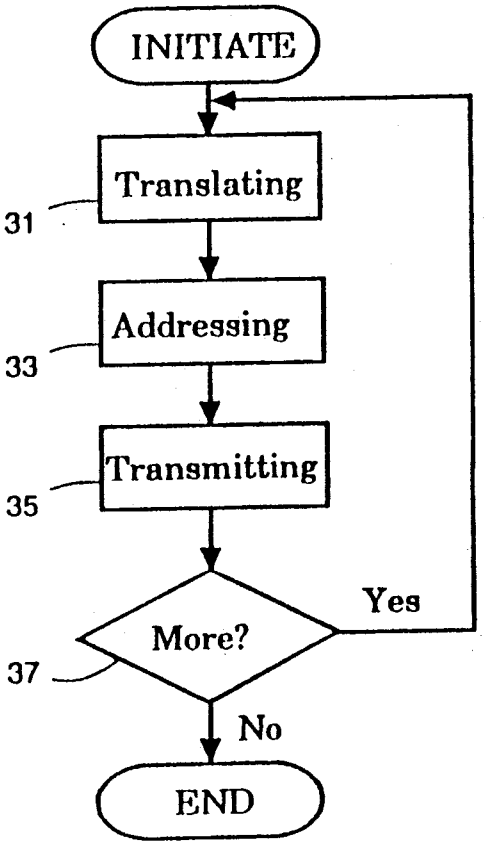
FIG. 3 is a flow chart illustrating principal steps in the control of a musical device by a set of graphical information in accordance with the present invention.

The flowchart of FIG. 3 describes the operation of the present invention in its reverse mode, from graphical image to sound data. In the reverse direction, a given graphical image is translated 31 into a set of one or more musical parameter addresses. These addresses are then used to address 33 a set of stored musical parameters. Again, the addressing step 33 can be either a true addressing of a look-up table of musical parameters, or can use an algorithm to generate the properties "on the fly." These addressed musical parameters can then be transmitted 35 to the musical instrument to be stored, mixed and/or converted into sound. Branching block 37 decides whether to repeat the translation, addressing and transmitting functions depending on the existence of further graphical information.

Figure 4:
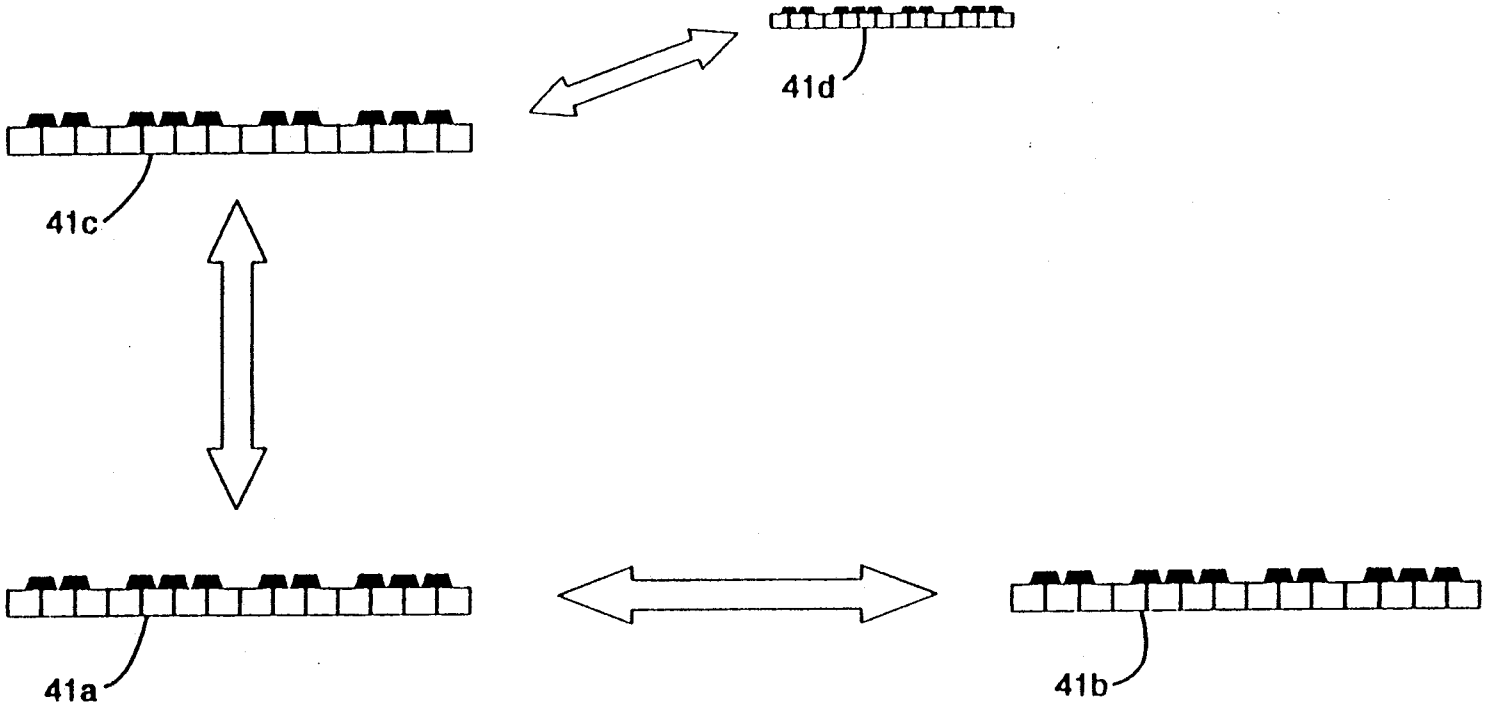
FIG. 4 is a diagram of a keyboard graphic image placed in different locations on a display.

FIG. 4 illustrates one possible implementation of the present invention. A graphical image of a musical instrument, here a simple keyboard 41, can be displayed on a CRT 15. The keyboard's spatial location can be altered depending upon the musical qualities being played simultaneous with the display. For example, movement of the sound in space from left to right can be accompanied by a translation of the keyboard image from left 41*a* to right 41*b*. Changes in frequency can similarly be shown. Low tones toward the bottom of the screen, 41*a* and 41*b*, can give way to high tones represented by motion toward the top of the screen 41*c*. Shrinking the image 41*d*, as a graphical illusion of receding into the distance, can accompany a lowering of music volume. Any number of such realistic or even other, more fanciful, effects can be employed using the present invention. As discussed, the binding of graphics and music information can occur in either direction. Either the music parameters can control the placement and appearance of images, or the changing display can alter the music parameters. Referring to FIG. 4, moving the keyboard image around the screen can create changes in the tones being created. These effects can be combined to provide realistic sound for computer animation.

While the present invention has been described with reference to preferred embodiments, those skilled in the art will recognize that various modifications may be provided. Other computer platforms can be used, as can different software systems. Different protocols for musical data can be employed. Different appearance effects can also be created in response to musical information. These and other variations upon and modifications to the described embodiments are provided for by the present invention, the scope of which is limited only by the following claims.

I claim:

1. A bi-directional method in a computer system for controlling a computer graphic display with a musical instrument and for controlling a musical instrument with a graphic display, wherein the method for controlling the computer graphic display with a musical instrument comprises the steps of:

sampling an output of the musical instrument to extract a set of digital instrument parameters;

adding a reference time-code signal to the digital instrument parameters;

passing the instrument parameters and the reference time-code signal to the computer system;

calculating video information by using a stored algorithm, the stored algorithm using the digital instrument parameters as inputs to the stored algorithm; and displaying the video information on the computer graphic display, the display of part of the video information being synchronized with the reference time-code signal; and wherein the method for controlling a musical instrument using a graphic display comprises the steps:

passing a reference time-code signal tot he computer system;

translating the graphic display data into a set of musical parameter addresses;

addressing a set of stored musical parameters by using the translated musical parameter addresses;

and transmitting the addressed stored music parameters to the electronic musical instrument in synchronization with the reference time-code signal.

2. The interface of claim 1, wherein the musical instrument is a MIDI sequencer.

3. The interface of claim 1, wherein the musical instrument directly generates digital data signals.

* * * * *

UNITED STATES PATENT AND TRADEMARK OFFICE

CERTIFICATE OF CORRECTION

PATENT NO. : 5,286,908

DATED : February 15, 1994

INVENTOR(S) : Stanley Jungleib

It is certified that error appears in the above-indentified patent and that said Letters Patent is hereby corrected as shown below:

Column 3, lines 50-51, delete "in additional" and insert --in addition--.

Column 6, line 28, delete "tot he" and insert --to the--.

Signed and Sealed this

Fifth Day of July, 1994

*Attest:*

Bruce Lehman

BRUCE LEHMAN

*Attesting Officer*

*Commissioner of Patents and Trademarks*